US011064859B1

(12) United States Patent
Hill

(10) Patent No.: US 11,064,859 B1
(45) Date of Patent: Jul. 20, 2021

(54) CLEANING APPARATUS AND METHOD OF USE

(71) Applicant: Jerome Hill, Denver, CO (US)

(72) Inventor: Jerome Hill, Denver, CO (US)

( * ) Notice: Subject to any disclaimer, the term of this patent is extended or adjusted under 35 U.S.C. 154(b) by 0 days.

(21) Appl. No.: 16/380,384

(22) Filed: Apr. 10, 2019

Related U.S. Application Data

(60) Provisional application No. 62/655,380, filed on Apr. 10, 2018.

(51) Int. Cl.

| | |
|---|---|
| ***A47L 13/04*** | (2006.01) |
| ***A47L 13/284*** | (2006.01) |
| ***A47L 13/42*** | (2006.01) |
| ***A47L 13/44*** | (2006.01) |
| ***A47L 13/07*** | (2006.01) |
| ***A47L 13/29*** | (2006.01) |
| ***A47L 13/24*** | (2006.01) |
| ***A47L 13/254*** | (2006.01) |

(52) U.S. Cl.
CPC ..... *A47L 13/04* (2013.01); *A47L 13/07* (2013.01); *A47L 13/284* (2013.01); *A47L 13/29* (2013.01); *A47L 13/42* (2013.01); *A47L 13/44* (2013.01); *A47L 13/24* (2013.01); *A47L 13/254* (2013.01)

(58) Field of Classification Search
CPC ..... A47L 13/04; A47L 13/07; A47L 13/28; A47L 13/284; A47L 13/29; A47L 13/34; A47L 13/44; A47L 13/022; A47L 13/06; A47L 13/10; A47L 13/16; A47L 13/20; A47L 13/24; A47L 13/254; A47L 13/256; A47L 13/257; A47L 13/42
USPC ... 15/147.2, 228, 229.11–229.13, 231, 244.2
See application file for complete search history.

(56) References Cited

U.S. PATENT DOCUMENTS

| | | | | | |
|---|---|---|---|---|---|
| 1,139,809 | A | * | 5/1915 | Schultz | A47L 13/16 15/209.1 |
| 1,632,481 | A | * | 6/1927 | Judge | A47L 13/29 15/114 |
| 3,713,744 | A | * | 1/1973 | Sims | A47L 13/22 401/9 |
| 4,204,295 | A | * | 5/1980 | O'Connor | A47L 13/022 15/229.13 |
| 5,402,559 | A | * | 4/1995 | Allison | A47L 13/10 15/228 |

FOREIGN PATENT DOCUMENTS

| | | | |
|---|---|---|---|
| CH | 124314 | * | 1/1928 |
| DE | 3108023 | * | 9/1982 |
| GB | 109877 | * | 10/1917 |
| GB | 191141 | * | 1/1923 |
| GB | 792162 | * | 3/1958 |

* cited by examiner

*Primary Examiner* — Mark Spisich
(74) *Attorney, Agent, or Firm* — Leavitt Eldredge Law Firm

(57) ABSTRACT

A cleaning apparatus includes an elongated handle; a base connected to the elongated handle at a first end via a swivel connector, the base having protrusions; and a steel wool attachment to secure to the base via the protrusions; the steel wool is to scrub a floor surface.

2 Claims, 4 Drawing Sheets

CLEANING APPARATUS AND METHOD OF USE

CROSS-REFERENCE TO RELATED APPLICATION

This application claims priority to provisional application 62/655,380 filed on Apr. 10, 2018, and is incorporated herein by reference in its entirety.

BACKGROUND

1. Field of the Invention

The present invention relates generally to cleaning apparatuses, and more specifically, to a cleaning apparatus having steel wool to aid in removing difficult substances from a floor surface.

2. Description of Related Art

Cleaning systems are well known in the art and are effective means to aid in cleaning a floor surface. For example, FIG. 1 depicts a conventional cleaning system 101 having a mop 102 and a bucket 104. During use, the user dips a mop head 105 into bucket 104 via a handle 107, wherein the user can then proceed to mop a floor.

One of the problems commonly associated with system 101 is limited cleaning power. For example, mop 102 is not effective in removing difficult substances, such as sticky and/or tacky material from a floor surface.

Accordingly, although great strides have been made in the area of cleaning systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
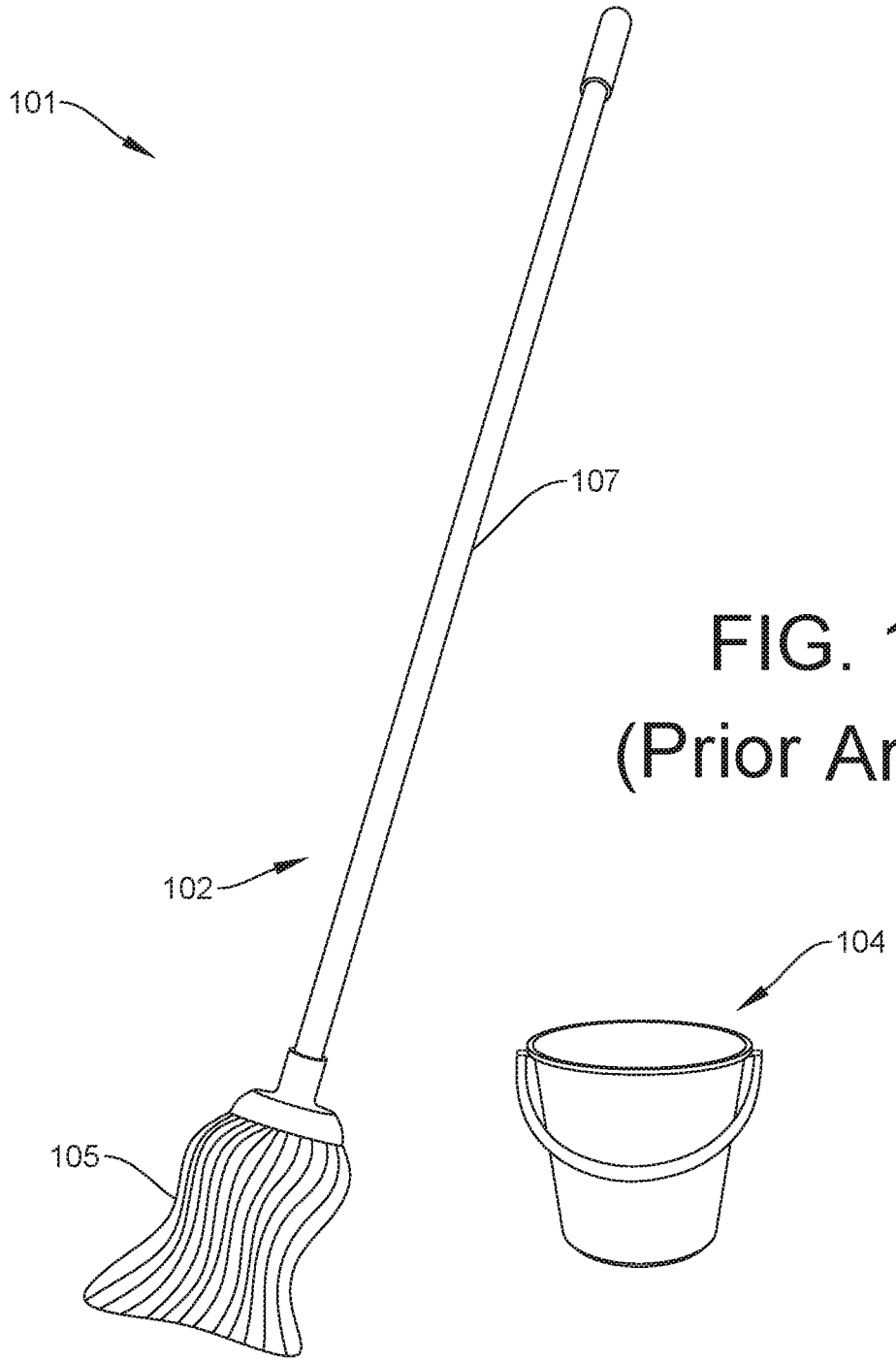
FIG. 1 (Prior Art)
FIG. 1 is a front view of a common cleaning system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional cleaning systems. Specifically, the present invention provides a means to increase the cleaning power of a mop via a steel wool attachment. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
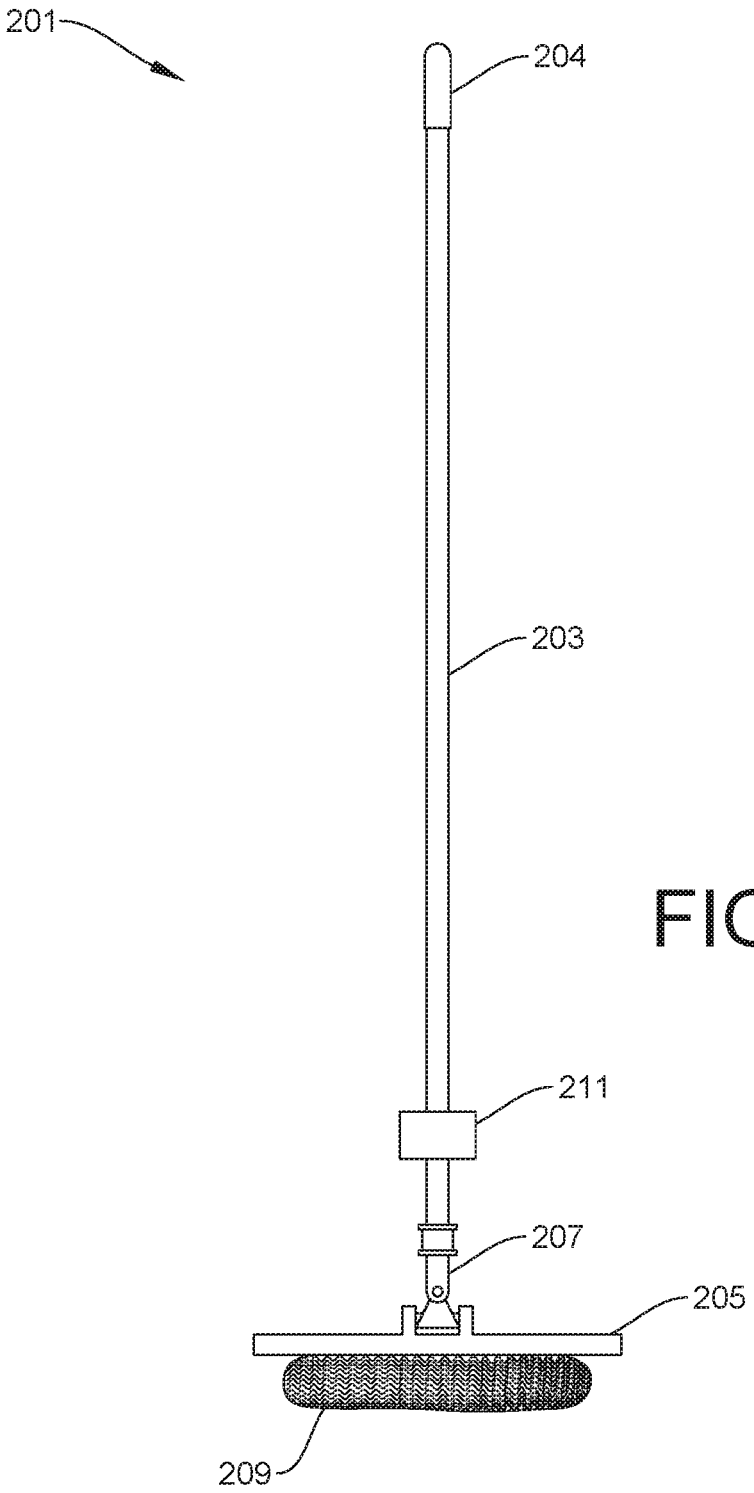
FIG. 2 is a front view of a cleaning apparatus in accordance with a preferred embodiment of the present application.
Figure 3:
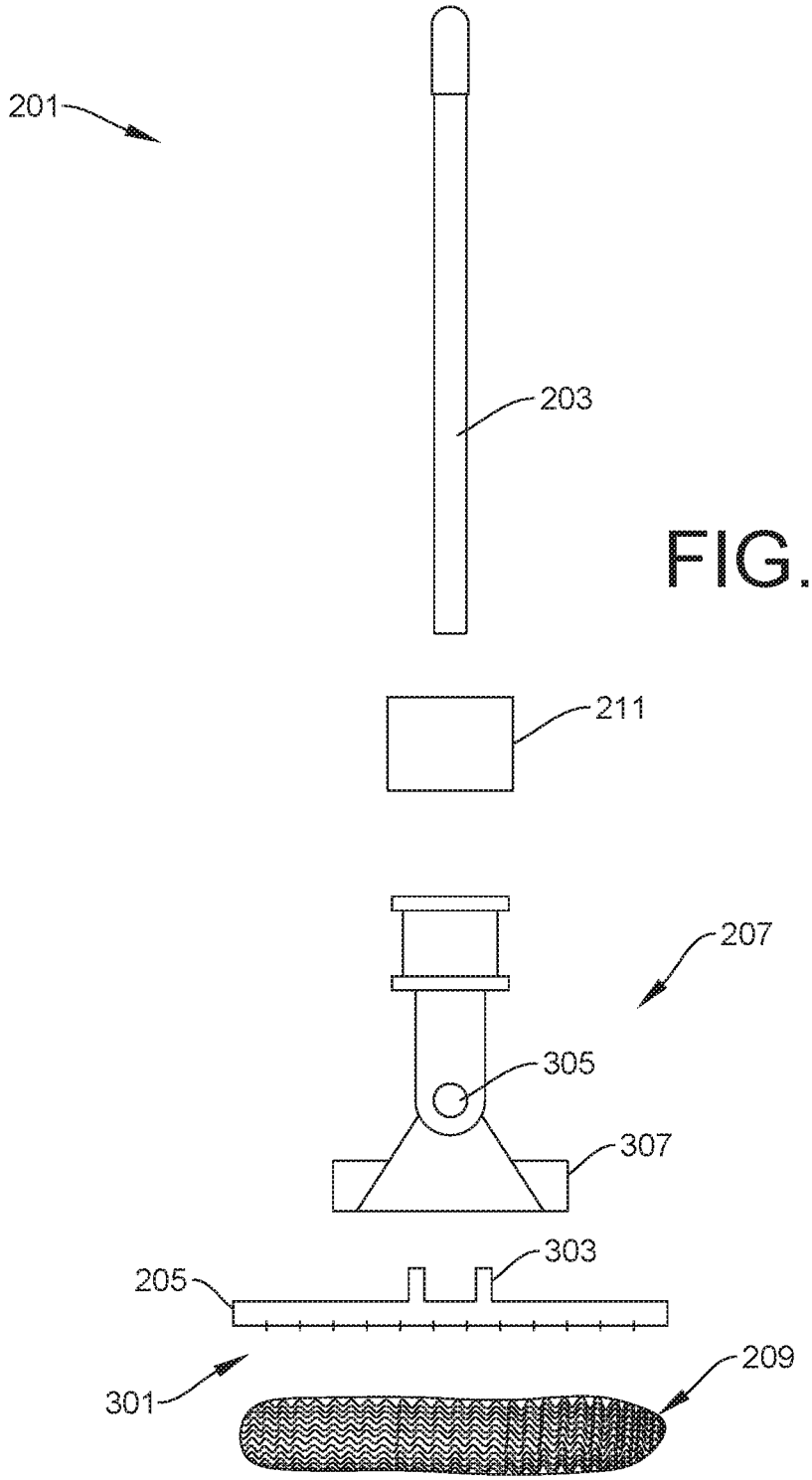
FIG. 3 is an exploded view of the cleaning apparatus of FIG. 2.

Referring now to the drawings wherein like reference characters identify corresponding or similar elements throughout the several views, FIGS. 2 and 3 depict a front view and an exploded view of a cleaning apparatus 201 in accordance with a preferred embodiment of the present application. It will be appreciated that apparatus 201 overcomes one or more of the above-listed problems commonly associated with conventional cleaning systems.

In the contemplated embodiment, apparatus 201 includes an elongated handle 203, which can have one or more grips 204 attached thereto. Elongated handle 203 is configured to attach to a base 205 via a swivel connection 207, which can allow for pivoting and swiveling of the base 205 for a full range of motion. In the preferred embodiment, a steel wool attachment 209 engages with base 205 via a plurality of protrusions 301. It should be appreciated that the protrusions removably lock into the steel wool, due to the weaving of the wool, similar to a hook and loop fastener.

In some embodiments, a weight 211 is configured to secure to handle 203, such as via a channel (not shown) extending through weight 211. Preferably, weight 211 is at least 5 pounds, which aids in the force exerted on the floor surface during cleaning.

As further shown in FIG. 3, base 205 includes one or more extensions 303 to engage with an elongated connection 307 of swivel connection 207. It should be appreciated that the swivel connection 207 includes a joint 305 allowing for rotation.

Figure 4:
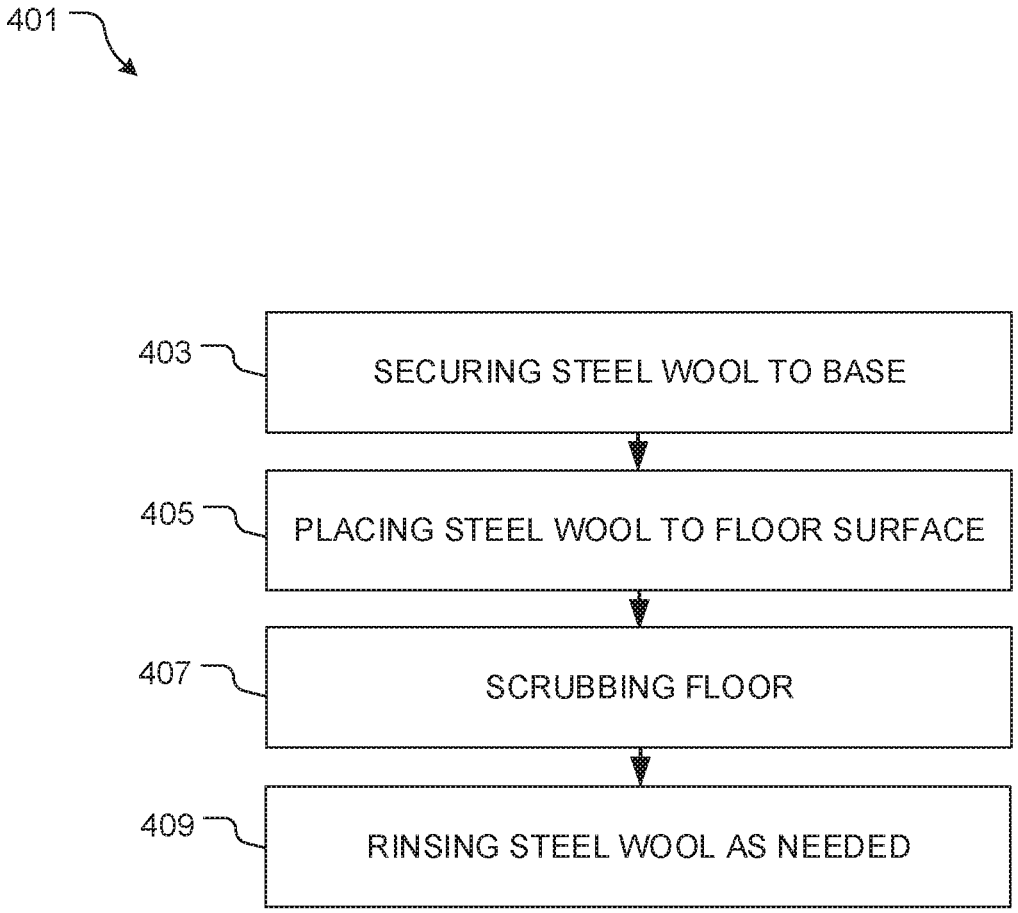
FIG. 4 is a flowchart of the method of use of the apparatus of FIG. 2.

In FIG. 4, a flowchart depicts a method of use 401 of apparatus 201. During use, the steel wool attachment is secured to the base, as shown in box 403. Tile user then proceeds to place the steel wool to the floor surface and scrubs the floor, as shown with boxes 405, 407. The user can then rinse off the steel wool as needed, as shown with box 409.

It should be appreciated that one of the unique features believed characteristic of the present application is the attachment of steel wool via a base to a handle, which provides for improved scrubbing power of a cleaning apparatus.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A cleaning apparatus, comprising:

an elongated handle;

a base having an upper surface provided with at least one extension member and a lower surface provided with a plurality of protrusions extending therefrom;

a swivel connection between an end of the elongated handle and the base, the swivel connection including a first elongated connection member couple to the at least one extension member of the base and a second connection member coupled to the first connection member by a joint providing rotation between the two connection members of the swivel connection and an end portion of the second connection member opposite the rotatable joint including means for attachment to the end of the handle;

a weight removably attached to the elongated handle spaced from the end portion of the second connection member, the weight including a channel through which a portion of the elongated handle extends;

a steel wool attachment configured to secure to the base via the plurality of protrusions; and wherein the steel wool is configured to scrub a floor surface.

2. The apparatus of claim 1, wherein the weight is a five pound weight.

* * * * *